US005853357A

United States Patent [19]

Jones, Jr.

[11] Patent Number: 5,853,357

[45] Date of Patent: Dec. 29, 1998

[54] ABDOMINAL EXERCISE ADAPTER

[76] Inventor: Frank Jones, Jr., 2472 Broadway #295, New York, N.Y. 10025

[21] Appl. No.: 915,484

[22] Filed: Aug. 20, 1997

[51] Int. Cl.[6] ..... A63B 23/02

[52] U.S. Cl. ..... 482/140; 482/131; 482/142

[58] Field of Search ..... 482/44–46, 51, 482/78, 91, 92, 95, 96, 106, 121–123, 129, 130, 131, 132, 139, 140, 142, 146, 148; D21/686–691; 297/270.1, 270.2, 270.3, 270.4, 270.5; 472/100, 109, 135; 292/343, DIG. 15; 16/82, 85

[56] References Cited

U.S. PATENT DOCUMENTS

| | | |
|---|---|---|
| D. 359,323 | 6/1995 | Ross . |
| 4,314,697 | 2/1982 | Brumfield et al. . |
| 4,602,782 | 7/1986 | Carlson . |
| 4,660,323 | 4/1987 | Kaines . |
| 5,331,719 | 7/1994 | Hum et al. . |
| 5,368,349 | 11/1994 | Hebert et al. . |

*Primary Examiner*—Jeanne M. Clark
*Attorney, Agent, or Firm*—Goldstein & Canino

[57] ABSTRACT

An abdominal exercise adapter comprising two wedges and a telescopic pole extending between the two wedges. Each wedge has a vertical edge, a horizontal edge, and a third edge extending between the former two. The third edge is concave shaped. A channel runs through the bottom of the horizontal edge. Vertical members of a lower frame of an abdominal exercise device fit in the channels of each wedge, thereby allowing the adapter to rest firmly on the exercise device. Vertical members of an upper frame of the exercise device cradle in the third edge of the adapter, thus preventing the frame from returning to a resting position. When the adapter is in use with an exercise device, a user endures a more challenging exercise session since the wedges of the adapter block the upper frame from descending past a certain point. Thus, the user is forced to keep her head off the head rest, and her stomach and abdominal muscles remain tense.

5 Claims, 2 Drawing Sheets

ABDOMINAL EXERCISE ADAPTER

BACKGROUND OF THE INVENTION

The invention relates to an abdominal exercise adapter. More particularly, the invention can easily be adapted to fit any existing abdominal exercise device.

Physical fitness is a growing trend for the general public. Older, as well as younger, generations are becoming more health conscious and trying to keep in better shape. One of the most common areas of the human body that people try to tone is the stomach. Many devices have been invented that focus on exercising the abdominal muscles, thereby improving the look of one's stomach.

"Sit-ups" are the most popular and best form of exercise involving the seldom used muscles in the stomach and abdominal areas of the body. Many devices have been formed that aid a user in performing sit-ups in a correct form while also allowing the user to isolate certain areas and muscles in the target area.

However, while most of these devices are suitable for a beginner, they often are not geared towards more advanced users. After using the devices for a while and building up one's muscles, the challenge in the devices diminishes. There is a need in the field for an attachment to these devices that would allow a more advanced user to continue to use said devices and still benefit from the exercise.

U.S. Pat. No. 4,314,697 to Brumfield et al. discloses a physical exercise device that allows a user to perform a variety of exercises for different parts of the body.

U.S. Pat. No. 4,602,782 to Carlson discloses a device for doing sit-ups and related exercises.

While these units may be suitable for the particular purpose employed, or for general use, they would not be as suitable for the purposes of the present invention as disclosed hereafter.

SUMMARY OF THE INVENTION

It is an object of the invention to produce an abdominal exercise adapter that aids the user in performing a variety of more challenging stomach and abdominal exercises.

It is a further object of the invention to produce an abdominal exercise adapter that can easily be attached to an existing abdominal exercise device for aiding a user in performing various stomach and abdominal exercises. By attaching the adapter, a user is able to enjoy a more challenging exercise session. A user is also able to isolate and develop a specific set of muscles.

It is a further object of the invention to produce an abdominal exercise adapter that can be adjusted to fit onto almost every existing abdominal exercise device. Further, the adapter can be incorporated into a device at the time of manufacture.

It is a still further object of the invention to produce an abdominal exercise adapter that a user can operate while exercising alone, without the aid of a second assisting person. Without the adapter, a second person is needed to add resistance to the abdominal exercise device in order for the user to reach the desired resistance level.

It is a still further object of the invention to produce an abdominal exercise adapter that can simply and quickly be collapsed. In the collapsed position, the adapter is easily stored and/or transported.

The invention is an abdominal exercise adapter comprising two wedges and a telescopic pole extending between the two wedges. Each wedge has a vertical edge, a horizontal edge, and a third edge extending between the former two. The third edge is concave shaped. A channel runs through the bottom of the horizontal edge. Vertical members of a lower frame of an abdominal exercise device fit in the channels of each wedge, thereby allowing the adapter to rest firmly on the exercise device. Vertical members of an upper frame of said exercise device cradle in the third edge of the adapter, thus preventing the frame from returning to a resting position when the adapter is in use with an exercise device, a user endures a more challenging exercise session since the wedges of the adapter block the upper frame from descending past a certain point. Thus, the user is forced to keep her head off the head rest, and her stomach and abdominal muscles remain tense.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
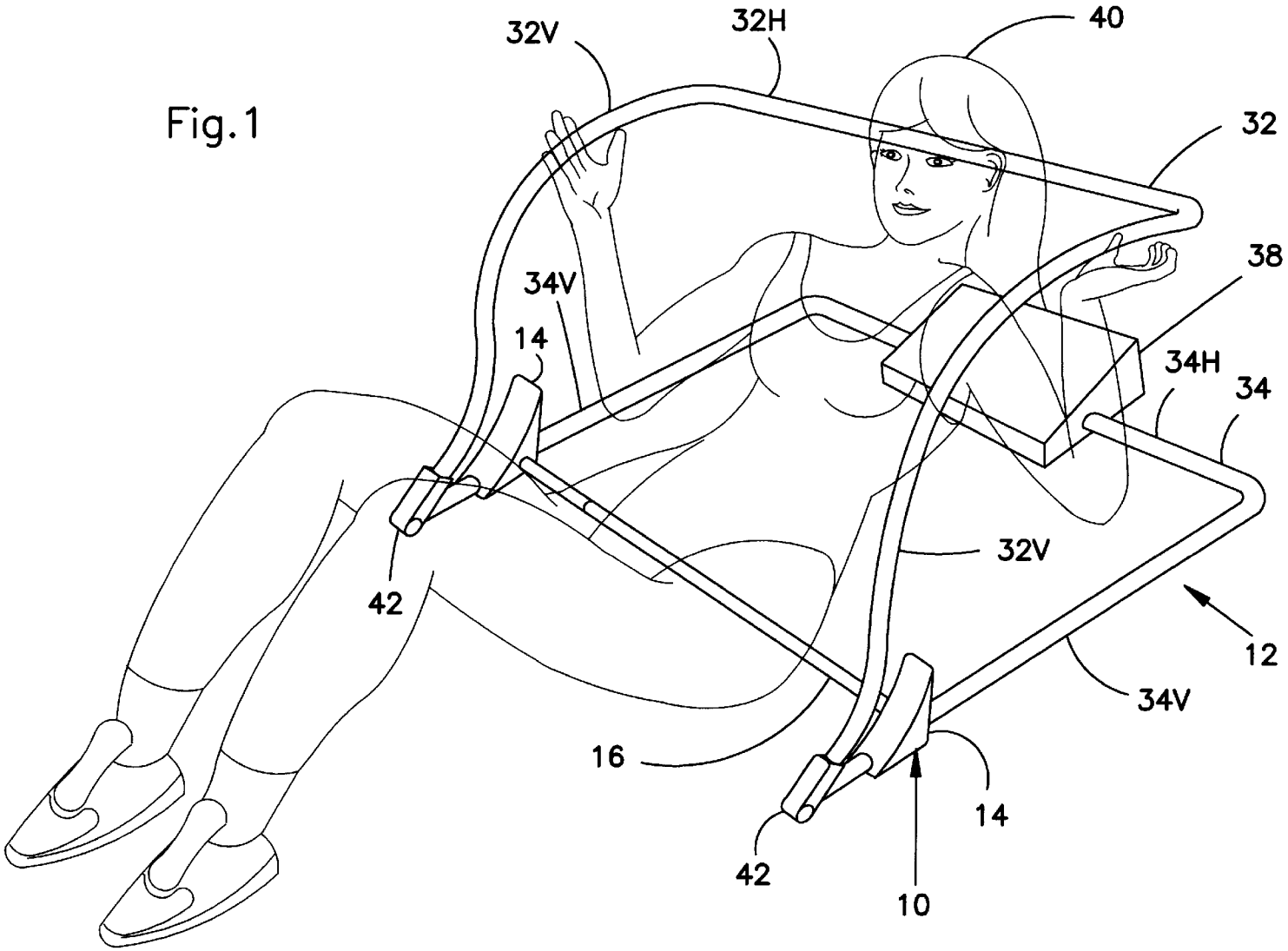
FIG. 1 is a perspective view illustrating a person using an abdominal exercise device with the abdominal exercise adapter attached thereto.

FIG. 1 illustrates a perspective view of an abdominal exercise adapter 10 attached to an abdominal exercise device 12. The abdominal exercise adapter 10 comprises two wedges 14 connected to each other by means of a telescopic pole 16.

Figure 3:
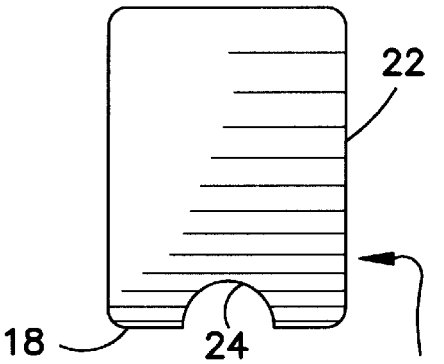
FIG. 3 is a front view of one of the wedges of the instant invention.
Figure 2:
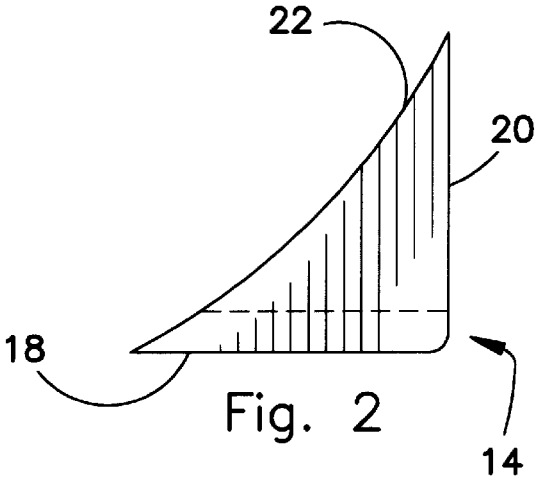
FIG. 2 is a side view of one of the wedges of the instant invention.

FIG. 2 illustrates a side view of one of the wedges 14. The wedge 14 is in the form of a triangle, having a vertical edge 20 and a horizontal edge 18 positioned perpendicular to each other at a right angle and a third edge 22 extending between the first two edges 18 and 20. The third edge 22 is concave shaped. FIG. 3 illustrates a front view of one of the wedges 14. A channel 24 is hollowed out of the horizontal edge 18 of each wedge 14.

Figure 4:
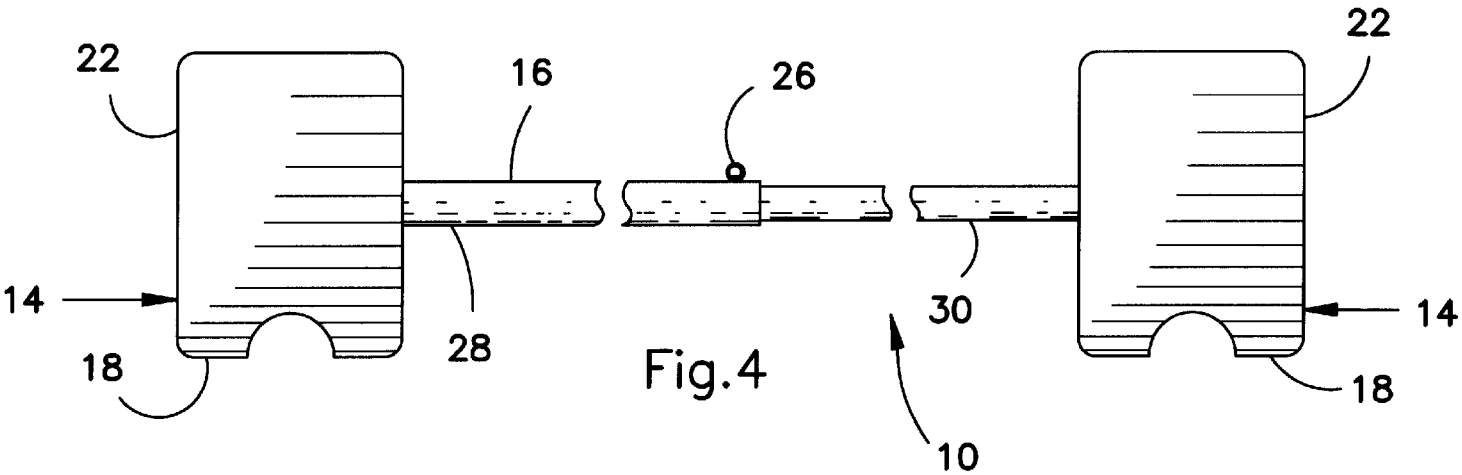
FIG. 4 is a front view of the abdominal exercise adapter.

FIG. 4 illustrates a front view of the abdominal exercise adapter 10. The telescopic pole 16 extending in between the two wedges 14, has a female end 28 and a male end 30. The male end 30 of the pole 16 is slightly smaller in diameter than the female end 28. The female end 28 is hollow, therefore able to accept the male end 30. A knob 26 is placed at the end of the female end 28 of the pole 26. The knob 26, when tightened, allows for no movement of either side of the pole 16. When loosened, the knob 26 allows the male end 28 to either extend inward of or outward from the female end 28. Thus, the telescopic pole 16 can be adjusted to be made longer or shorter in order to adapt to virtually any abdominal exercise device 12.

The abdominal exercise device 12 comprises an upper frame 32 and a lower frame 34, each frame having a horizontal member 32H and 34H and two vertical members 32V and 34V. The vertical members 32V of the upper frame 32 are S-shaped. A head rest 38 is positioned in the middle of the lower horizontal member 34H. A user 40 would position herself so that her head was on the head rest 38 and her upper body was between the two lower vertical members 34V. Her hands would push on the two upper vertical members 32V, thus aiding her in performing sit-ups. The vertical members 32V of the upper frame 32V and the lower frame 34V are attached at hinged points 42.

The abdominal exercise adapter 10 is positioned over the two lower vertical members 34V. The members 34V fit into the channels 24 found on the horizontal edge 18 of each wedge 14, thus allowing the adapter 10 to rest firmly on the abdominal exercise device 12. The concave shaped edge 22 of each wedge 14 cradles the upper vertical members 32V.

Without the abdominal exercise adapter 10 in place on the abdominal exercise device 12, the user 40 would return to the resting position, with her head on the head rest, after each sit-up. When the adapter 10 is placed on the exercise device 12, the upper frame 32 would be blocked from descending past a certain point. Thus, the user 40 is forced to keep her head off the head rest 38, and her stomach and abdominal muscles remain tense. The user 40 is then more challenged in her exercise session.

What is claimed is:

1. An abdominal exercise adapter, in combination with an abdominal exercise device, comprising:

two triangular shaped wedges, each having a horizontal edge, a vertical edge and a third edge extending between the two, the third edge of each wedge being concave shaped; and a pole extending between the two wedges, wherein said abdominal exercise device includes an upper frame and a lower frame, each having one horizontal member and two vertical members and the two frame are joined at a hinge and wherein each wedge rests in a vertical member of the lower frame of the abdominal exercise device, thus when the vertical members of the upper frame of the abdominal exercise device come into contact with the third edge of each wedge, the upper frame is blocked from descending past a certain point and the user is prevented from returning to the rest position in between exercises.

2. The abdominal exercise adapter as recited in claim 1, wherein a channel extends through each horizontal edge of the wedges.

3. The abdominal exercise adapter as recited in claim 2, wherein channels are shaped and configured to allow the vertical members of the lower frame of the abdominal exercise device fit into the channels in the wedges, thus allowing the abdominal exercise adapter to rest firmly on the exercise device.

4. The abdominal exercise adapter as recited in claim 3, wherein the pole extending between the two wedge is telescopic, said pole having a hollow female end and a male end, the male end being slightly smaller in diameter than the female end.

5. The abdominal exercise adapter as recited in claim 4, wherein a knob is positioned on the female end of the telescopic pole, the knob when tightened allows no movement of either end of the pole and when loosened allows the male end to extend inward to or outward from the female end of said pole.

* * * * *